United States Patent [19]

Thomasma et al.

[11] 4,257,557

[45] Mar. 24, 1981

[54] FLUID HEATING SYSTEM UTILIZING SOLID FUEL

[76] Inventors: William S. Thomasma, Old Plank Rd., De Pere, Wis. 54115; John F. Wilson, P.O. Box 862, Green Bay, Wis. 54305

[21] Appl. No.: 955,193

[22] Filed: Oct. 27, 1978

[51] Int. Cl.[3] ..... F24D 3/08

[52] U.S. Cl. ..... 237/19; 122/373; 126/112; 126/132; 126/163 R

[58] Field of Search ..... 237/19, 8 R, 52; 122/373, 20 B, 18; 126/5, 60, 101, 362, 104 R, 112, 132, 83, 366; 110/326; 165/163

[56] References Cited

U.S. PATENT DOCUMENTS

| | | | |
|---|---|---|---|
| 112,120 | 2/1871 | Burrells | 122/373 |
| 245,814 | 8/1881 | Grennell | 122/373 |
| 284,545 | 9/1883 | Fair | 126/112 |
| 358,621 | 3/1887 | Paine | 126/104 R |
| 370,981 | 10/1887 | Smead | 126/104 R |
| 726,834 | 4/1903 | Williamson | 122/20 A |
| 1,016,261 | 2/1912 | Gallagher | 126/5 |
| 1,125,183 | 1/1915 | Rymal | 126/5 |
| 1,379,581 | 5/1921 | Smith | 122/20 A |
| 1,415,432 | 5/1922 | Edwards | 165/173 |
| 1,430,466 | 9/1922 | Nilson | 122/20 B |
| 1,440,810 | 1/1923 | Zacharias | 237/19 |
| 1,874,602 | 8/1932 | Owen | 122/20 A |
| 2,017,251 | 10/1935 | Klein | 122/4 |
| 2,039,066 | 4/1936 | De Weese | 165/163 X |
| 2,143,874 | 1/1939 | Hagenson et al. | 122/20 |
| 2,178,189 | 10/1939 | Sonnier | 126/362 |
| 2,594,507 | 4/1952 | Sigerist | 122/275 |
| 3,352,298 | 11/1967 | Hope | 110/326 X |
| 4,046,320 | 9/1977 | Johnson et al. | 237/51 X |

FOREIGN PATENT DOCUMENTS

| | | | |
|---|---|---|---|
| 62537 | 11/1923 | Norway | 126/60 |

*Primary Examiner*—Albert J. Makay
*Assistant Examiner*—Henry Bennett
*Attorney, Agent, or Firm*—Neuman, Williams, Anderson & Olson

[57] ABSTRACT

A fluid heating system specifically designed for the use of solid bulk fuel, such as wood or the like. The burner unit includes a continuous coil of fluid carrying conduit which acts both as a grate for supporting the fuels of combustion and as the primary implement for circulating fluids in close proximity to the combustion material so as to maximize the heat absorption by the fluid. Primary and secondary combustion air inlets combine with a baffling system that maximizes the efficiency of the combustion process within the heat transfer coil. Room heating and hot water storage apparatus are also disclosed as desirable end uses for the heated fluid.

19 Claims, 4 Drawing Figures

FLUID HEATING SYSTEM UTILIZING SOLID FUEL

BACKGROUND OF THE INVENTION

This invention relates generally to fluid heaters and more particularly to fluid heaters specifically designed for the utilization of bulky solid fuels.

Bulk fuels such as wood have had a resurgence in popularity as the cost of oil and gas have surged in recent years. However, while effective wood burners and boilers have been available for many decades, the increased cost of energy has only recently renewed interest in applying new materials and design techniques to the age-old tasks of burning wood and heating water.

Boilers have been proposed that circulate water through or around a firebox to allow it to extract heat from the combustion process. Recently proposed designs have sought to utilize the circulating pipes themselves as functional elements in the combustion chamber. Carlson U.S. Pat. No. 3,934,554, for example, discloses a water heater in which water chambers or tanks on either side of the firebox are interconnected by upper and lower conduits, the lower conduits being spaced to function as grates to hold the fuel. A substantial amount of manufacturing expertise and labor is required to interconnect the upper and lower conduits to the water jackets of the Carlson unit, thus providing a substantial economic drawback to the utilization of such a unit.

Substantial advances have also been made in the design of wood stoves with an eye toward substantially improving their efficiency. It has been observed that high levels of efficiency require a stove design that is essentially air-tight to provide for complete combustion. Most high-efficiency units utilize controlled air intakes to provide just enough oxygen to burn the wood as completely as possible without releasing unburned gases up the chimney. Internal baffles and vents have been incorporated in numerous wood stoves to aid in the combustion process by introducing secondary air to the gases released from the primary combustion process and burning this air-enriched mixture completely within the combustion chamber. Two step stoves of this type are very efficient and reduce the amount of leftover ash to a minimum.

SUMMARY OF THE INVENTION

The present invention effectively combines the technologies of modern boilers and efficient wood stoves to overcome the limitations of prior systems and to provide for a wood-fired water heater which is economical to manufacture and which has the efficiency of the best of the modern woodburning stoves. More specifically, it is an object of the present invention to provide a woodburning stove which effectively integrates the fluid-carrying components of the water heating system as an aid in the combustion process for the wood fuel.

It is another object of the present invention to provide a woodburning water heater which contains relatively few parts so as to enhance the ease and economy of manufacture and assembly.

It is still a further object of the present invention to provide a woodburning water heater providing a maximum degree of control for the combustion process so as to make the heater useful for automatically regulated boiler or heating systems.

The foregoing objects are realized through the provision of a fluid heating system in which the combustion chamber of a woodburning stove is comprised of a continuous coil of fluid carrying conduit, the turns of the coil being spaced and shaped so that the bottom of the coil may function as a grate, while the sides of the coil provide for the entrance of secondary combustion air to aid the combustion process. In one embodiment an internal shell conforming to the outside shape of the coil provides for the controlled application of primary combustion air to the fuel burning process and, together with a baffle plate located near the top of the coil, provides for the mixing of secondary combustion air with the gases released from the wood during primary combustion so as to create secondary combustion toward the upper portions of the coil. Fluid for the coil may be forced through the system with an external pump, or, in the absence of the pump or in a failure of power, fluid will continue to be circulated upward through the coil by convection.

Other objects and advantages of the present invention will become apparent upon reading the following detailed description and appended claims, and upon reference to the accompanying drawings.

While the invention will be described in connection with certain preferred embodiments, it will be understood that we do not intend to limit the invention to those embodiments. On the contrary, we intend to cover all alternatives, modifications and equivalents as may be included within the spirit and scope of the invention as defined by the appended claims.

DESCRIPTION OF THE PREFERRED EMBODIMENTS

Figure 1:
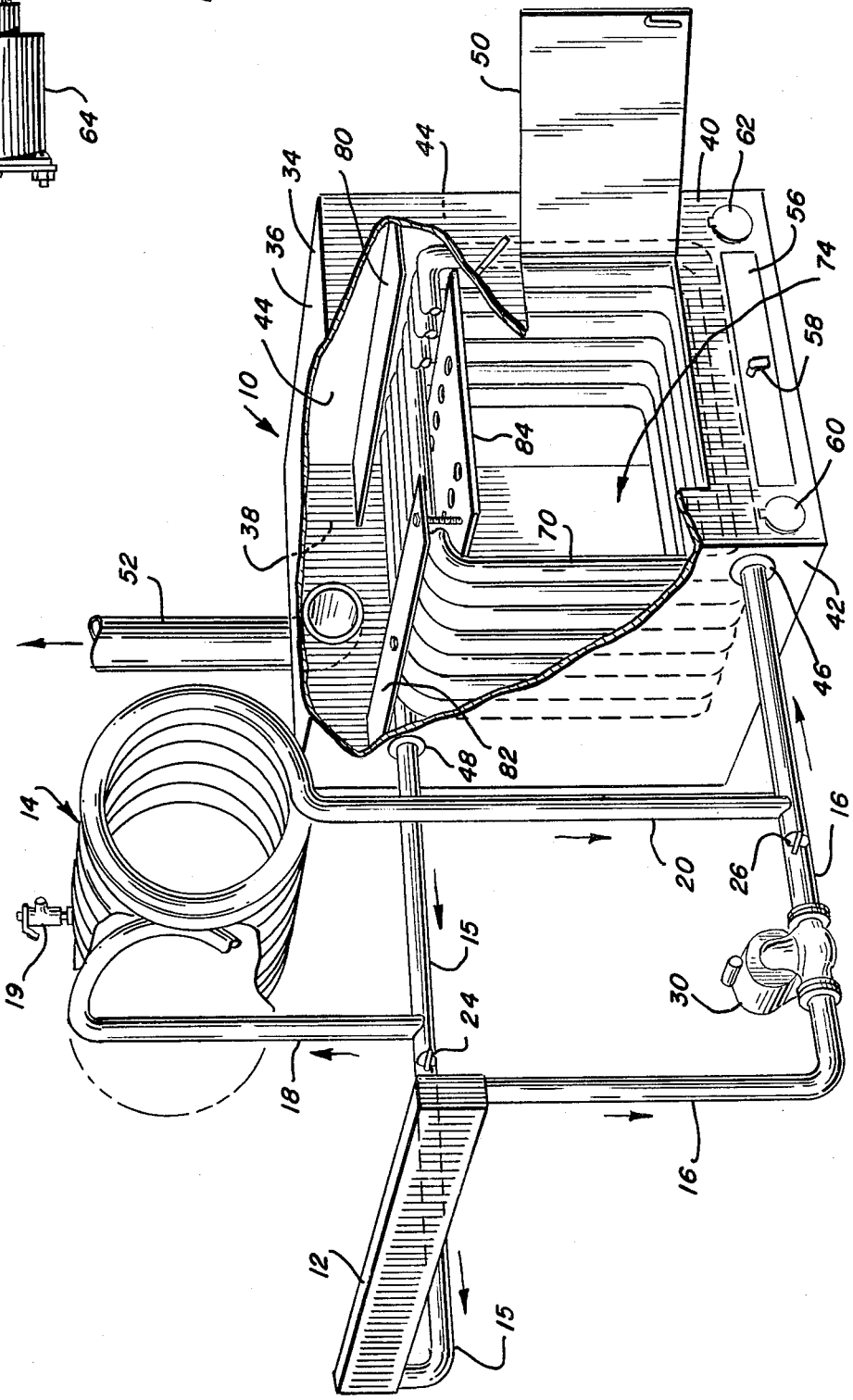
FIG. 1 is a perspective view, partially cut away, of a woodburning fluid heating system constructed in accordance with the present invention.

Turning first to FIG. 1, there is shown a water heating system including a firebox 10 for the burning of solid fuels, a radiating room heater 12 and an auxiliary heating coil 14 which may be a part of a domestic hot water heating system or the like. A system of pipes or conduits interconnects the aforesaid components in a closed loop system and includes a line 15 delivering fluid to the heater unit 12 and a conduit 16 returning fluid from the heater 12 to the firebox 10. A further pair of conduits 18, 20 connects the pipes 15, 16, respectively, to either end of the coil 14 for supplying fluid into and out of the coil 14. A one-way check valve 24 maintains fluid flow through the conduit 15 in a direction running from right to left, while a one-way check valve 26 maintains fluid flow from left to right through the conduit 16.

While the water heating unit within the firebox 10 may in may instances maintain the flow of fluid throughout the conduit system through the use of convection currents resulting from the combustion of fuels, circulation within the system will normally be maintained through the force of an external pump 30 located within the return line 16 from the room heater. Of course, although a single room heater 12 is shown, it is contemplated that the system will normally operate with a series of many such heaters connected in series or parallel.

The firebox 10 consists of an external housing 34 having a upper surface 36, a back surface 38, a front surface 40 and a pair of sidewalls 42 and 44. In the sidewall 42 there are located a pair of openings 46, 48 to which the inlet and outlet portions of the fluid carrying conduit extends in a heat-sealing fitting.

Consistent with conventional woodburning stoves, the unit 10 further includes a hinged access door 50 through which wood or other fuels are inserted into the combustion chamber. The unit 10 also includes an exhaust stack 52 shown as emanating from the rear wall 38 of the firebox 10 near the upper surface thereof. For the purpose of removing the ash developed during the combustion process, there is provided a drawer (not shown in detail) extending along the bottom of the firebox 10 and having a front face 56 with a handle 58 provided for ease of removal of the ash tray. A slideable tray (shown more specifically as element 114 of FIG. 3) is typically provided above the drawer to support the ashes during combustion.

Figure 2:
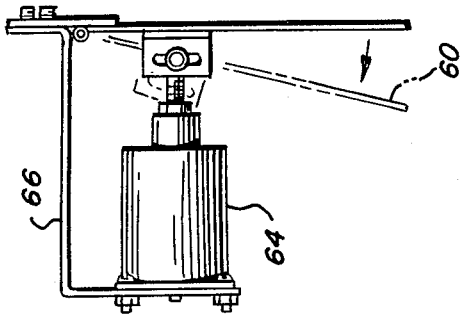
FIG. 2 is a side view of the solenoid controlled damper and components for the heating system shown in FIG. 1.

For the purpose of controlling the inlet of combustion air to the firebox 10, there is provided a pair of hinged doors 60, 62 on the lower portion of the front face 40 of the firebox 10. The mechanism of the doors 60, 62 is shown in more detail in FIG. 2. Operation of the doors is controlled by an electrical solenoid unit 64 supported on a bracket 66 which extends to and is mounted on the front face 40 of the firebox 10 via suitable screws or bolts. The combustion air allowed within the firebox 10 can thus be controlled electrically in accordance with the settings of a thermostatically controlled system (not shown) in a manner conventional to systems of this type.

In accordance with one aspect of the present invention, a continuous fluid carrying conduit is provided within the firebox 10, and is so shaped and disposed within the firebox as to provide the dual functions of supporting the fuels for combustion and carrying the heat absorbing fluid into the proximity of the burning fuel so as to allow for the rapid absorption of heat by the fluid. To this end, the embodiment shown in FIG. 1 includes a continuous coil of conduit 70 having its axis disposed horizontally, front to back, within the firebox 10. The inlet to the coil 70 is a continuous extension of the inlet conduit 16 that is located near the bottom of the coil, while the outlet from the conduit 70 is continuous with the outlet coil 14 described above and is located toward the top of the coil 70 so as to allow for fluid flow by convection during the combustion process.

As depicted in FIG. 1, each individual turn of the coil 70 is heat formed into a rectangular shape and aligned side by side with each of the other turns of the coil so as to define a combustion chamber 74 for enclosing the fuel for combustion. To facilitate its performance as a grate for supporting the fuel, the turns of the coil 70 are separated at least along the lower portion thereof to allow primary combustion air to flow to the burning fuel from the controlled air inlet valves 60 and 62. The choice of tubing or piping used for forming the coil 70 is an important aspect of the invention, since the conduit will be put under severe mechanical and heat stress both during its manufacture and during its operation within the unit. A suitable pipe for this purpose is a type designated A106 Schedule 40 Seamless Pipe. The diameter of the pipe should be not less than $\frac{3}{4}$ inches to prevent scale build-up during operation. In addition, the pipe is pressure tested to 2500 pounds to withstand the substantial pressures created by the heated fluid.

To enhance the efficiency of the heat transfer to the fluid in the lower portion of the coil 70, the ash shelf or tray is constructed so as to extend over substantially the entire bottom of the coil 70 exterior to the chamber 74. This shelf, which is not shown in detail in FIG. 1, supports the ashes and burning coals in close proximity to the conduit.

In accordance with another aspect of the present invention venting and baffle means are provided near the upper region of the combustion chamber 74 so as to enrich the unburned gases released from the fuel in the lower part of the chamber for more complete secondary combustion at the top of the chamber. It has been ascertained that as much as 60 percent of the heat content from wood, for example, can be lost if the gases released from the wood during primary combustion are allowed to escape unburned. To enhance the secondary combustion of these gases in the upper reaches of the chamber 74, there is provided on the interior of the firebox outer housing 34 a pair of shelf-like baffle plates 80, 82 which may be fastened to the housing 34 by welding or the like. The baffles 80 and 82 extend into the firebox sufficiently to enclose at least the outer edges of the coil 70 from the top while being separated a space sufficient to allow air passage to the exhaust flue 52. Supported from and disposed below the baffle plates 80 and 82 is a third and primary baffle plate 84 disposed horizontally within the chamber 74 and extending laterally into an overlapping but spaced relationship with the baffle plates 80 and 82. The primary baffle plate 84 has holes formed therein along its outer edges to allow the passage of heat and exhaust gases to the upper portion of coil 70. In operation, the gases released from the fuel during primary combustion in the lower portion of the chamber 74 are diverted by the primary baffle plate 84 away from the center of the chamber and into contact with secondary air being admitted along the lateral edges of the plate 84 through the upper side portions of the coil 70, the individual conduit segments of which are spaced sufficiently to allow the passage of such air. In effect, the baffle plate 84 acts to break up and disperse the molecules of the gas for recombination with oxygen entering the upper regions of the chamber 74 through the sides of the coil 70. A highly combustible mixture results that burns rapidly to heat the water in the very upper portions of the coil 70. This complete combustion throughout the chamber 74 reduces the likelihood that cold spots will develop within the fluid in the coil 70 that would interfere with the normal convection flow otherwise developed.

As noted above, while substantial flow of fluid can be maintained through convection currents alone throughout the system, many applications will make the use of the pump 30 desirable to aid in the fluid flow. Forced fluid flow caused by the pump 30 will speed the distribution of heat carrying fluid throughout the system and reduce the likelihood of scale developing as a result of the boiling out of mineral deposits from the fluid in the coil 70 as well as provide better, more uniform heating. The pump 30 is electrically controlled.

It is noted that the auxiliary coil 14 provided for external water heating purposes (the complete water heater chamber and tank is not shown) is a closed coil with its inlet conduit 18 entering at a horizontal level. A pressure relief valve 19 is illustrated projecting from the top of the coil 14 and is provided as a safety precaution. Valves of this type automatically open to release steam and reduce pressure at a predetermined danger level.

Figure 3:
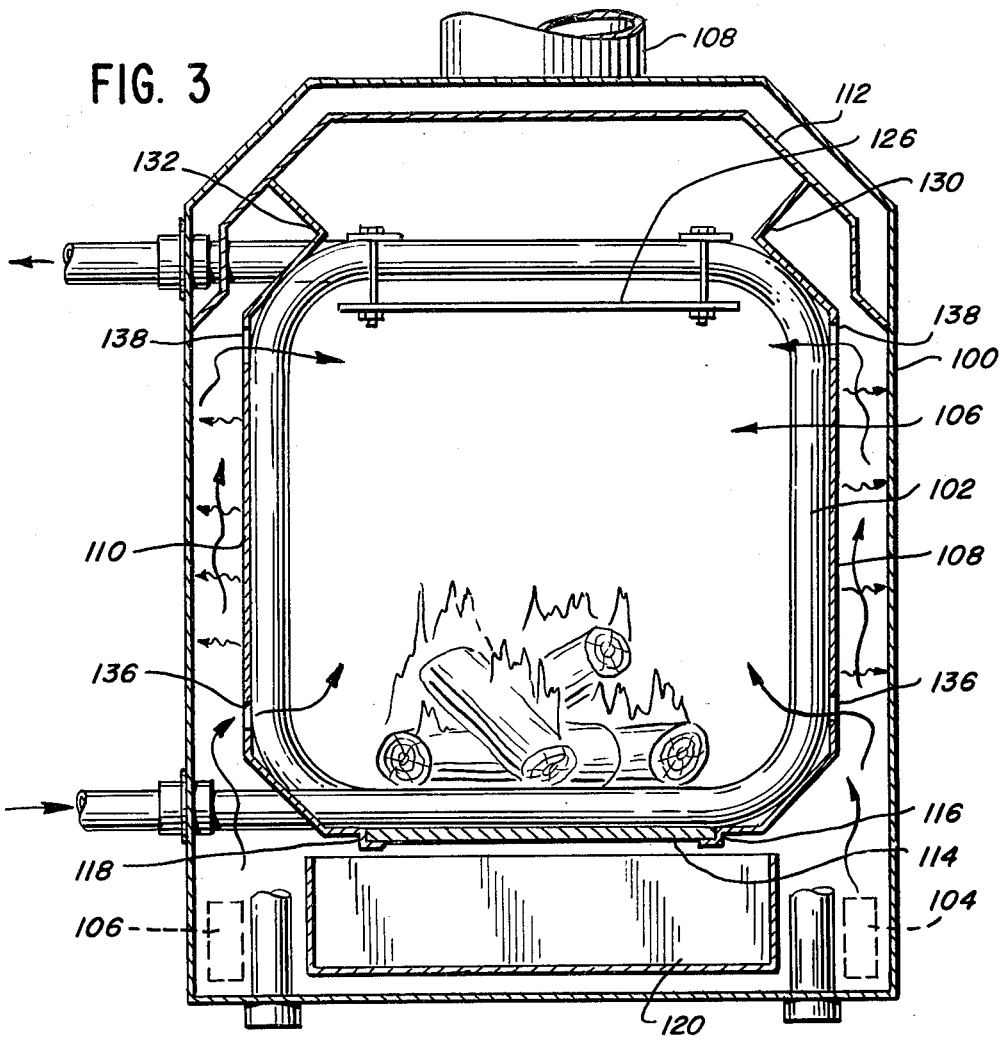
FIG. 3 is a cross-sectional view of an alternate embodiment of the present invention.
Figure 4:
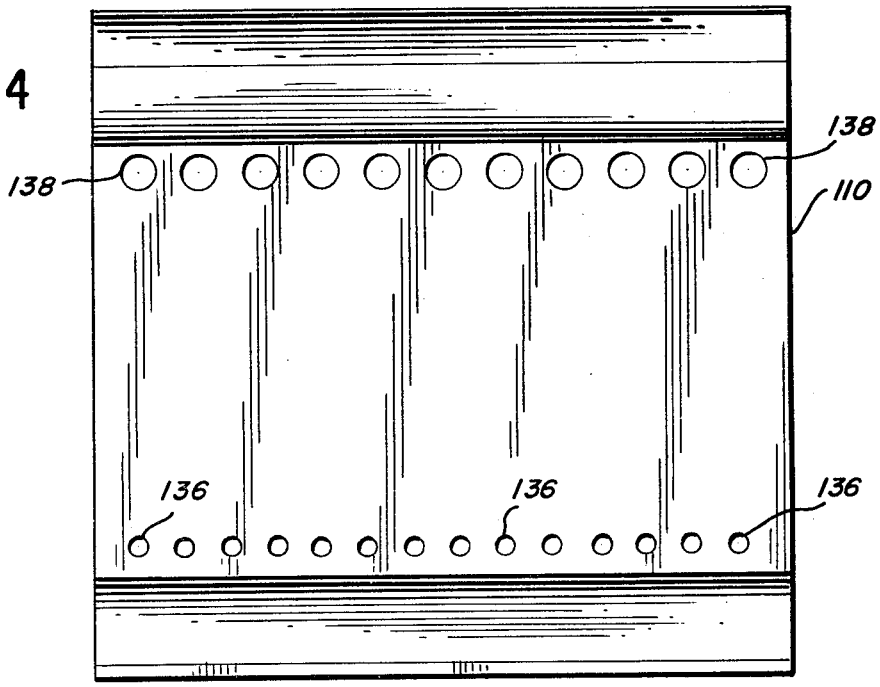
FIG. 4 is a side view of one of the shell walls of the embodiment shown in FIG. 3.

In accordance with another aspect of the present invention means may be provided for creating an auxiliary air space or chamber between the outer shell 34 of the firebox 10 and the coil 70 so as to allow for the more precise control of primary and secondary air for the combustion process. A firebox modified for this purpose is depicted in FIGS. 3 and 4. While only the firebox is shown in FIGS. 3 and 4, it will be understood that the combustion unit shown is intended to operate with a more complete system such as that shown in FIGS. 1 and 2, the auxiliary components of which are a matter of system design choice. As in the previous embodiment, the firebox or stove of FIG. 3 includes an outer shell 100, a fluid carrying conduit in the shape of a coil 102, a pair of damper controlled air inlet doors 104, 106 and an exhaust flue 108. The embodiment of FIG. 3 is shown in cross-sectional form from the front with the air inlet doors 104 and 106 being shown in broken lines for functional purposes only. Unless otherwise specified, the general configuration and components of this embodiment are the same as those shown for FIGS. 1 and 2.

In order that air flow into the combustion chamber 106 may be carefully controlled to occur at an optimum level and in appropriate volume, there is provided an inner shell structure having right and left side walls 108 and 110, respectively, which substantially conform to the shape of the sides of the coil 102 and extend partially around the upper and lower corners thereof. Each of the shell walls 108 and 110 extend upward into engagement with an upper inner shell surface 112 supported at its lateral sides in a junction with the sheet metal of the outer housing 100. Between the lower extremities of the chamber side walls 108 and 110 there is an ash support tray or plate 114 slide mounted for front to back movement in a pair of flange projections 116, 118 formed on the bottom edges of the shell side plates 108 and 110. This shelf 114, which is accessible from the front of the unit via a handle (not shown), supports the burning coals and ashes from the wood in intimate contact with the fluid carrying conduit. The small amount of ash left over after complete combustion is removed via the normal ash drawer 120 in the normal manner.

For enhancing the combustion of gases in the upper portion of the chamber 106 of the embodiment of FIG. 3, there is a baffle structure similar to that disclosed for FIG. 1. Specifically, the horizontal baffle plate 126 is suspended from the top of the coil by suitable bolts or fasteners. The baffle plate 126 extends outward toward the curved corner portions of the coil to a corner area in which it underlies the inwardly projecting upper portions 130 and 132 of the shell side walls 108 and 110. The plate 126 may have holes formed therein and performs the same function as the similar plate disclosed for FIG. 1, namely the diversion and dispersal of rising gases from the burning fuel such that those gases can be enriched by oxygen for burning at the upper regions of the chamber 106.

The oxygen-containing air for both primary and secondary combustion is provided through a series of ports or vents located in the side plates 108 and 110 of the inner shell in a manner more graphically shown in FIG. 4. For primary combustion the side plates have a series of relatively small holes 136 located along the line slightly above the bottom of the chamber 106 so as to allow primary combustion air from the vents 104 and 106 to reach the burning fuel. The holes 136 are spaced to correspond to the openings between the turns of the coil 102.

Additional venting is provided near the top of the side wall plates of the inner shell to allow oxygen from the air space to enter the upper region of the chamber 106 for effecting secondary combustion of the gases released from the fuel. This venting occurs through a series of holes 138 disposed linearly along the top of the plates 108, 110 at a level slightly below the baffle plate 126. Like the holes 136, the holes 138 are spaced to conform to the openings between the individual turns of the coil 102. As another feature of this embodiment it is noted that the secondary combustion air is preheated as it rises between the inner shell and outer housing, further enhancing its ability to enrich the gaseous mixture near the top of the chamber 106. Typically the primary air inlet holes 136 are $\frac{1}{2}$ inch in diameter, while the secondary air inlet holes 138 are $1\frac{1}{4}$ inch in diameter. These sizes result from the discovery that secondary combustion of the gases requires approximately two to three times more oxygen than is required for the primary combustion of the fuels.

The firebox 10 shown in FIG. 1 is well adapted to act as a room heater as well as a boiler for the delivery of heated fluid to remote locations. The firebox unit of FIG. 3 may similarly be used as a room heater, but the provision of an internal metal shell around the coil 102 and the combustion chamber 106 makes it possible to provide insulation, preferably of the reflective type, along the inside of the outer housing 100 so as to confine the heat of combustion within the chamber for delivery to the fluid carrying coil 102. Both the front and rear sections of the outer housing 100 can also be of double thickness metal to allow for an air space or supplementary insulation along those surfaces.

From the foregoing it will be apparent that there has been brought to the art a new and improved fluid heating system for burning wood or other solid fuels. This system provides for a highly efficient combustion process and is both easy and inexpensive to manufacture and assemble.

We claim as our invention:

1. In a fluid heeating stove having a substantially closed firebox for the combustion of solid fuels and venting means for controlling the inlet and exhausting of combustion air, a continuous fluid carrying conduit disposed within said firebox for supporting the fuels for combustion and for carrying a heat absorbing fluid into proximity with the burning fuel so as to allow for absorption of heat by said fluid, said conduit being shaped as a continuous coil having its axis disposed horizontally, said coil surrounding a center chamber which is disposed horizontally within said firebox, the bottom of said horizontally disposed coil having conduit portions spaced apart so as to define a grate for supporting said fuel while allowing for the passage of combustion air to the burning fule, said fire box having shell portions along the sides of said coil with secondary air inlet means there in the upper sides of said coil having conduit portions spaced apart to allow combustion air which has been heated by passage along the said shell portions to enter said center chamber, said chamber further having a horizontally disposed baffle plate internal to and near the top of said chamber above said secondary air inlet means for diverting the gases released from combustion of said fuel toward the sides of said center chamber and into contact with said heated combustion air entering through the upper sides of said coil to cause combustion of said released gases and enhance the uniformity of heat distribution throughout said coil.

2. In a fluid heating system a substantially closed firebox for the combustion of solid fuels having controllable venting means for the inlet and exhaust of combustion air, a continuous fluid carrying conduit having a first portion enclosed within said firebox, said first portion being formed into a coil having a horizontally disposed axis and multiple turns spaced to define a center chamber interior to said coil for holding said solid fuels during combustion, said conduit having an inlet portion near the bottom of said horizontally disposed coil for the entrance of unheated fluid and an outlet portion near the top of said coil for the discharge of fluid, said fire box having shell portions along the sides of said coil with secondary air inlet means therein the upper sides of said coil having conduit portions spaced apart to allow combustion air which has been heated by passage along the said shell portions to enter said center chamber, said chamber further having a horizontally disposed baffle plate internal to and near the top of said chamber for diverting the gases released from combustion of said fuel toward the sides of said center chamber above said secondary air inlet means and into contact with said heated combustion air entering through the upper sides of said coil to cause combustion of said released gases and enhance the uniformity of heat distribution throughout said coil.

3. The fluid heating system of claim 2 further including means for forcing fluid through said coil from said inlet portion to said outlet portion so as to increase the heat transfer between said fuel and said fluid during combustion and to supplement the flow of fluid resulting from the convection caused by heating the fluid.

4. The fluid heating system of claim 2 wherein said conduit has portions external to said firebox and further includes means for radiating heat from said fluid to the surrounding air from said external conduit portions.

5. The fluid heating system of claim 2 further including a water heating tank having inlet and outlet ports, said fluid carrying conduit having portions external to said firebox disposed within said water heating tank.

6. The fluid heating system of claim 5 wherein the portion of said conduit within said water heating tank is a continuous coil having multiple spaced turns for effecting the transfer of heat from the fluid within said conduit to the water within the tank.

7. The fluid heating system of claims 2, 3, 4, 5 or 6 wherein said conduit consists of $\frac{3}{4}''$ pipe.

8. A stove for the combustion of solid fuels to heat fluid comprising:

a substantially closed outer housing of sheet metal material;

continuous conduit means having inlet and outlet portions extending through said outer housing for transporting fluid into and out of said housing, said conduit means also having a medial portion between said inlet and outlet portions formed into a box-like coil for supporting said solid fuel and for extracting heat from said fuel during combustion;

an inner shell of sheet metal at least partially surrounding the medial portion of said conduit means to define a combustion chamber for said fuel, said inner shell and outer housing each having a corresponding side selectively ported to allow access to the combustion chamber for the addition or removal of said fuel;

said inner shell having a plurality of primary air inlets located at or about the level of the burning fuels and a plurality of secondary air inlets located at a level substantially above said primary air inlets to allow secondary air to be heated as it passes upward between the inner and outer shells and upon entering said chamber to circulate above the fuel so as to enhance the combustion of gases emitted from the burning fuel;

means above said secondary air inlet means for diverting gases emitted from said fuel toward said secondary air inlets; and, an exhaust means to provide for the escape of burned gases from the area above the medial portion of said conduit means.

9. A fluid heating stove according to claim 8 wherein said outer shell has vent means for the inlet of air and wherein said stove further includes means for controlling the opening and closing of said vent means in accordance with the desired degree of combustion.

10. A fluid heating stove in accordance with claim 8 wherein said inner shell and outer housing are separated by an air space and wherein said outer housing has vent means for supplying combustion air to the primary and secondary air inlets of said inner shell.

11. A fluid heating stove in accordance with claim 8 further including a removable ash tray normally disposed as a bottom portion of said inner shell immediately below the medial portion of said conduit means for maintaining the burning fuel in intimate contact with said conduit during combustion.

12. A fluid heating stove according to claim 8 wherein said diverting means is a horizontally disposed baffle plate disposed at a vertical position within said inner shell which is slightly above said secondary air inlets for diverting unburned gases emitted from the burning fuel toward said secondary air inlets to create a combustible mixture of said gases with secondary air.

13. A fluid heating stove according to claims 9 or 12 wherein the cross-sectional area of said secondary air inlets is 2 to 3 times greater than the cross-sectional area of said primary air inlets.

14. A stove for the combustion of solid fuel to heat fluids comprising;

a substantially closed outer housing;

a continuous conduit having inlet and outlet portions extending through the outer housing for transporting fluid into and out of said housing and a medial portion between said inlet and outlet portions, said medial portion being formed into a multi-turn coil about a horizontally disposed axis, and said coil being of sufficient length and width to define a chamber within said coil for holding said solid fuel such that said coil is heated during combustion of said fuel, the turns of said coil being axially spaced sufficient to allow air to pass through said coil to said chamber;

a substantially closed inner shell structure cooperating with said outer housing and surrounding at least the bottom and lateral sides of said coil, said inner shell structure being spaced from said outer housing along the bottom and at least one side of said coil to define an air space exterior to said chamber, said outer housing having vent means located below said coil for controlling the amount of outside air entering said space;

primary air aperture means located near the bottom of said inner shell structure for allowing air to pass from said air space into the proximity of said fuel through the turns of the coil; and secondary air aperture means located above said primary aperture means in said inner shell structure for allowing air which has been heated during passage upward along said inner shell to pass from said air space through the turns of said coil above the level of said fuel so as to create secondary combustion near the top of said chamber of the unburned gases released from the fuel and baffle means located within said coil above said secondary air aperature means for enhancing said secondary combustion.

15. A stove according to claim 14 for the combustion of solid fuels to heat fluids wherein the turns of said coil are formed rectangularly and aligned with one another along said horizontal axis to define a box-like chamber.

16. A stove in accordance with claim 14 for the combustion of solid fuel to heat fluids, wherein said inner shell includes a pair of side walls adjacent the lateral sides of said coil and wherein said primary air aperture means is a plurality of holes disposed in each of said sidewalls at a level slightly above the bottom of said coil such that primary combustion air may enter through said holes without the loss of ashes through said holes.

17. A stove in accordance with claim 14 for the combustion of solid fuels to heat fluid wherein said secondary air aperture means are ports in said inner shell disposed along a generally horizontal line near the top of said chamber, said stove further including a horizontally disposed baffle plate suspended within said chamber near the level of said secondary air aperature ports such that unburned gases rising from said fuel during combustion are diverted toward said ports and combine into a flammable mixture with the secondary air entering through said ports.

18. A stove in accordance with claim 14 for the combustion of solid fuels wherein the secondary air aperture means are sized to pass 2 to 3 times as much air as said primary air aperture means.

19. A stove in accordance with claim 16 for the combustion of solid fuel to heat fluids wherein said inner shell has a bottom portion horizontally disposed to support the fuel in intimate contact with said coil and wherein said bottom portion is movable with respect to said sidewalls to allow ashes to drop from said chamber.

* * * * *